US008307989B2

(12) United States Patent
Takai et al.

(10) Patent No.: US 8,307,989 B2
(45) Date of Patent: Nov. 13, 2012

(54) PAPER HANDLING APPARATUS AND METHOD THEREFOR

(75) Inventors: Tomoyo Takai, Owariasahi (JP); Yuji Nagaya, Seto (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 362 days.

(21) Appl. No.: 12/457,253

(22) Filed: Jun. 4, 2009

(65) Prior Publication Data

US 2009/0285470 A1 Nov. 19, 2009

(30) Foreign Application Priority Data

Jun. 5, 2008 (JP) ..... 2008-148077

(51) Int. Cl.
*B07C 5/00* (2006.01)

(52) U.S. Cl. ..... 209/534; 194/206; 382/135

(58) Field of Classification Search ..... 194/262, 194/263, 206, 207; 209/534
See application file for complete search history.

(56) References Cited

U.S. PATENT DOCUMENTS 7,131,539 B2 * 11/2006 Mukai ..... 209/534
7,631,743 B2 * 12/2009 Takai et al. ..... 194/206
2005/0133339 A1 * 6/2005 Mukai ..... 194/207
2005/0133990 A1 6/2005 Mukai
2007/0007103 A1 * 1/2007 Takai et al. ..... 194/206

FOREIGN PATENT DOCUMENTS

JP 2007-018170 7/2005
WO WO 2004/022465 A1 8/2002

OTHER PUBLICATIONS

Extended European Search Report of Application No. EP 09 00 7320.6-1229/2131335, dated Aug. 11, 2010.

* cited by examiner

*Primary Examiner* — Kaitlin Joerger
(74) *Attorney, Agent, or Firm* — Stites & Harbison, PLLC; Juan Carlos A. Marquez, Esq

(57) ABSTRACT

A bill handling apparatus having a thickness detection sensor 401 for detecting the thickness of bills; optical sensors 405 and 406 for acquiring images of the profiles and surfaces of the bills; a judgment unit for judging the positions and directions of folds of the bills with the use of signals obtained with the thickness detection sensor 401 and the optical sensors 405 and 406; and a control unit for exercising control such that if a judgment result of the judgment unit shows that the position and direction of a fold of a folded bill are unlikely to cause double bill transfer during bill transfer by considering the relationship of the folded bill to a bill located immediately before or after the folded bill, the folded bill is kept in the apparatus without being returned to the user.

9 Claims, 13 Drawing Sheets

FIG. 8

| | HEIGHT OF BILL STORED LAST IS LOWER THAN FOLDED BILL STORED NEXT | HEIGHT OF BILL STORED LAST IS GREATER THAN FOLDED BILL STORED NEXT |
|---|---|---|
| FOLDED BACKWARD | TO REJECT STACKER 11 | TO TEMPORARY STORAGE UNIT 4 |
| FOLDED FORWARD | TO TEMPORARY STORAGE UNIT 4 | TO TEMPORARY STORAGE UNIT 4 |

FIG. 10

| | HEIGHT OF BILL STORED LAST IS LOWER THAN FOLDED BILL STORED NEXT | HEIGHT OF BILL STORED LAST IS GREATER THAN FOLDED BILL STORED NEXT |
|---|---|---|
| FOLDED BACKWARD | TO TEMPORARY STORAGE UNIT 4 | TO TEMPORARY STORAGE UNIT 4 |
| FOLDED FORWARD | TO TEMPORARY STORAGE UNIT 4 | TO TEMPORARY STORAGE UNIT 4 |

FIG. 11

| DEPOSIT ORDER | POSITION OF FOLD | DIRECTION OF FOLD | HEIGHT OF BILL | TRANSFER DESTINATION |
|---|---|---|---|---|
| FIRST BILL | NONE | NONE | 60mm | TEMPORARY STORAGE UNIT 4 |
| SECOND BILL | UPPER CORNER | BACKWARD | 80mm | REJECT STACKER 11 |
| THIRD BILL | NONE | NONE | 90mm | TEMPORARY STORAGE UNIT 4 |
| ⋮ | | ⋮ | | ⋮ |

PAPER HANDLING APPARATUS AND METHOD THEREFOR

CLAIM PRIORITY

The application claims priority from Japanese application serial no. 2008-148077 filed on Jun. 5, 2008, the content of which is hereby incorporated by reference into this application.

BACKGROUND OF THE INVENTION

1. Field of the Invention

The present invention relates to apparatuses and methods for handling paper and particularly to an automated teller machine (ATM) that handles bills, some of which have folds.

2. Description of the Related Art

When a great number of bills are handled by an ATM, some of which have folds, these folds may hook another bill, resulting in a double bill transfer and making bill transfer unstable. Thus, folded bills are one of the causes that affect the operation of ATMs. To avoid the double bill transfer, common practice is that when an ATM detects folded bills among the bills the user inserted into the ATM, the ATM returns those folded bills to the user without letting them in the ATM.

The handling of folded bills is disclosed, for example, in PCT WO 2004/022465 (PCT/JP2002/008813). In the bill handling apparatus there, if a fold of a bill found during corner fold judgment operation is located at a corner of the bill that is unlikely to cause any double bill transfer upon subsequent bill transfer, that bill is stored in the reusable bill cartridge of the apparatus without being returned to the user.

Also, JP-A-2007-18170, discloses a bill handling apparatus in which if the apparatus finds folded bills among the bills the user deposits, those folded bills are returned to the user. The folded bills are unfolded by the apparatus prompting the user to unfold and straighten the folded bills and deposit them again.

In ATM deposit transaction, when folded bills are returned to the user, the user needs to unfold and straighten the folded bills one by one, which is quite time consuming. In addition, the operating time of the ATM for the user further increases when the user has to deposit the straightened bills. Thus, when folded bills are found, returning all of the folded bills to the user impairs convenience for the user and also reduces the operating rate of the ATM.

SUMMARY OF THE INVENTION

An object of the invention is thus to provide a bill handling apparatus which does not bother the users by storing folded bills in the apparatus in particular cases without returning the folded bills to the users.

The invention is preferably a paper handling apparatus for handling a plurality of pieces of paper, the apparatus being utilized by a user and comprising:

a first sensor for detecting the thickness of the plurality of pieces of paper;

a second sensor for acquiring images of the plurality of pieces of paper, the images showing the profiles and surfaces of the plurality of pieces of paper;

a judgment unit for judging the positions and directions of folds of the plurality of pieces of paper with the use of the thickness information acquired with the first sensor and the image information acquired with the second sensor; and a control unit for controlling the apparatus such that when a judgment result of the judgment unit shows that the position and direction of a fold of a piece of paper are in particular states in relation to another piece of paper located immediately before or after the piece of paper, the piece of paper is kept in the apparatus without being returned to the user.

Preferably, the paper handling apparatus further comprises:

a temporary storage unit for temporarily storing bills deposited by the user; and a plurality of cartridges for storing bills usable for withdrawal, each of the plurality of cartridges storing bills of a particular denomination, the plurality of cartridges being connected via a transfer path to the temporary storage unit, wherein if the judgment unit judges, upon transfer of the bills deposited by the user to the temporary storage unit, that there is a good chance of double bill transfer during bill transfer from the temporary storage unit to the plurality of the cartridges by considering the position and direction of a fold of a folded bill among the bills deposited by the user in relation to another bill located immediately before or after the folded bill, the control unit transfers the folded bill so as to return the folded bill to the user, and if the judgment unit judges there is no chance of double bill transfer, the control unit transfers the folded bill to the temporary storage unit.

Preferably, the paper handling apparatus handles bills of various heights and of various denominations, wherein even when the judgment unit detects, with the use of the thickness information acquired with the first sensor, a folded bill among deposited bills by the user upon transfer of the bills deposited by the user to the temporary storage unit, the control unit transfers the folded bill so as to return the folded bill to the user if the judgment unit judges there is a good chance of double bill transfer by considering the position and direction of a fold of the folded bill and the relationship between the height of the folded bill and the height of another bill transferred immediately before or after the folded bill, and the control unit transfers the folded bill to the temporary storage unit if the judgment unit judges there is no chance of double bill transfer.

Preferably, the paper handling apparatus further comprises a memory unit for sequentially storing information on the positions and directions of folds of bills and the height of the bills on a bill-by-bill basis, the information being obtained by the judgment unit.

Preferably, the paper handling apparatus further comprises a reject bill cartridge for storing bills that cannot be used for withdrawal, wherein when the judgment unit detects, upon transfer of bills stored in the temporary storage unit to the plurality of bill cartridges for storage, a folded bill among the bills transferred out of the temporary storage unit, the control unit exercises control so as to transfer the folded bill to the reject bill cartridge and to transfer the rest of the bills that are not judged to be folded by the judgment unit to the plurality of bill cartridges.

Preferably, the invention is a paper handling method for use in a paper handling apparatus that handles a plurality of pieces of paper and is utilized by a user, the method comprising the steps of:

detecting the thickness of the plurality of pieces of paper with the use of a first sensor located on a transfer path along which to transfer the plurality of pieces of paper;

acquiring images of the plurality of pieces of paper with the use of a second sensor located on the transfer path, the images showing the profiles and surfaces of the plurality of pieces of paper;

judging the positions and directions of folds of the plurality of pieces of paper with the use of information acquired with the first and second sensors; and controlling the apparatus such that when a judgment result of the judgment step shows that the position and direction of a fold of a piece of paper are in particular states in relation to another piece of paper located immediately before or after the piece of paper, the piece of paper is kept in the apparatus without being returned to the user.

In accordance with the invention, a folded bill is stored in a bill handling apparatus (ATM) without being returned to the user when the relationship between the folded bill and a bill located immediately before or after the folded bill is in given states. This can save the time for the user to unfold and straighten folded bills and deposit them again and reduce the users' wait time for their turn in front of the ATM.

DETAILED DESCRIPTION OF THE DRAWINGS

FIG. 8 is a table showing the transfer destinations of the folded bills of FIGS. 7A to 7D.

FIG. 10 is a table showing the transfer destinations of the folded bills of FIGS. 9A to 9D.

FIG. 11 illustrates a storage format of a judgment unit memory 108.

DETAILED DESCRIPTION OF THE PREFERRED EMBODIMENTS

A preferred embodiment of the invention is described below with reference to the accompanying drawings.

Figure 1:
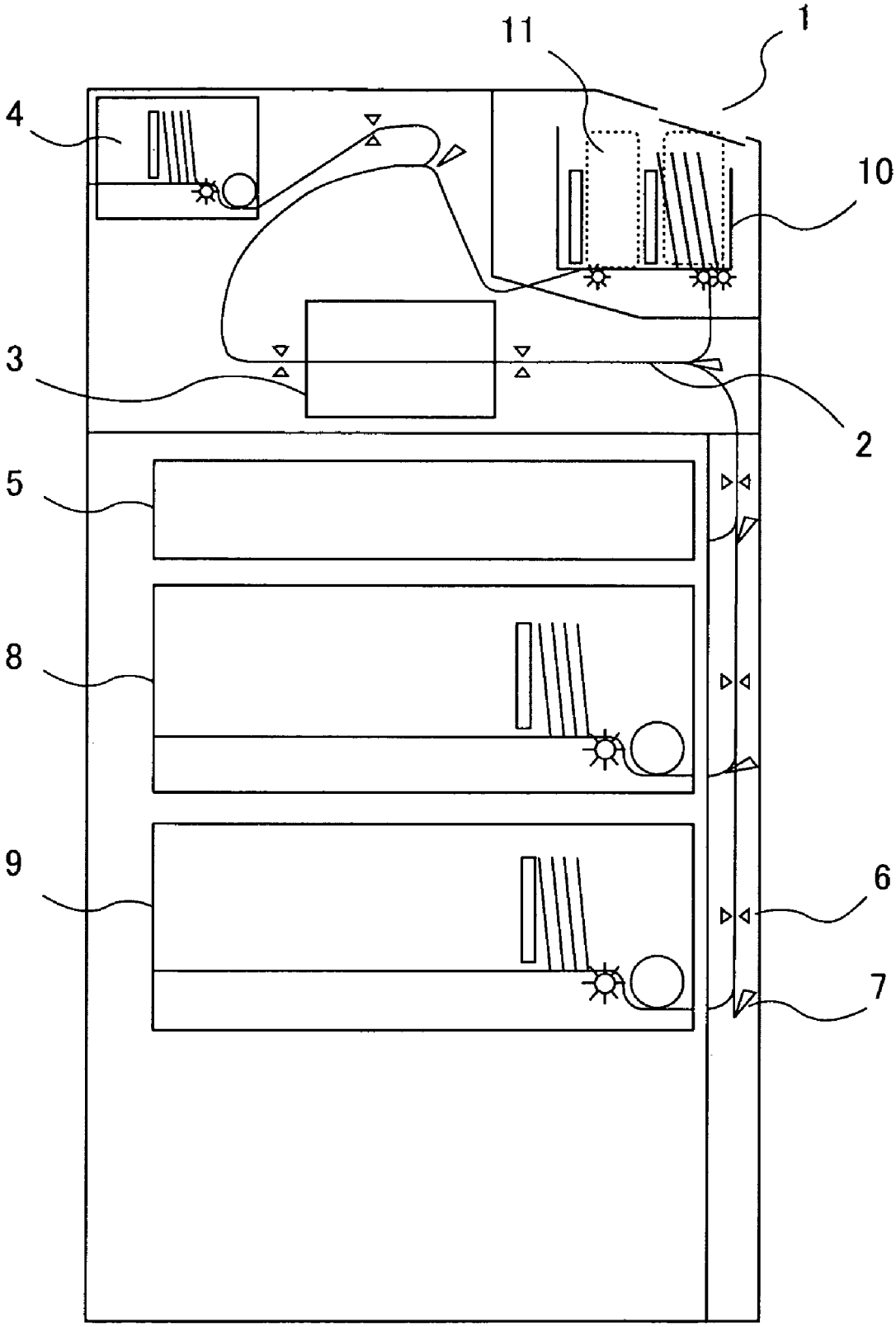
FIG. 1 illustrates the physical configuration of a bill handling apparatus according to an embodiment of the invention.

FIG. 1 is a schematic diagram of a bill handling apparatus according to the embodiment, in which the apparatus is embodied as an ATM. Reference numeral 1 of FIG. 1 denotes a bill deposit/withdrawal section. Reference numeral 2 denotes a transfer path along which to transfer bills to particular portions of the apparatus. Reference numeral 3 denotes a judgment unit that examines the denominations, authenticity, and thickness of bills and also examines which direction bill corners are folded in (i.e., forward or backward) based on the thickness examined and information obtained with optical sensors. Reference numeral 4 denotes a temporary storage unit for temporarily storing received bills including bills to be rejected. Reference numeral 5 denotes a reject bill cartridge for storing bills not to be reused (called "reject bills"). Reference numeral 6 denotes a sensor for detecting the passage of bills, located at a particular position along the transfer path 2. Reference numeral 7 denotes a gate that changes the transfer direction of a bill. Reference numerals 8 and 9 denote bill cartridges each for storing bills of a particular denomination. When bills are withdrawn as specified by the user, the bills are delivered from those bill cartridges 8 and 9. Reference numeral 10 denotes a hopper which is provided at the bill deposit/withdrawal section 1 and in which the user places bills during deposit transaction. Reference numeral 11 denotes a reject stacker used chiefly for returning reject bills to the user.

The operation of the bill handling apparatus above during bill deposit transaction is briefly discussed below.

In a bill deposit transaction, the user first inserts bills into the hopper 10 of the bill deposit/withdrawal section 1. The bills are separately transferred from the hopper 10 to the transfer path 2 one by one. The judgment unit 3 examines the denominations, the authenticity, and folds of the bills and determines where to transfer the bills. Bills judged to be authentic are transferred to the temporary storage unit 4, where they are stored temporarily. Bills judged to have folds and satisfy given conditions are also transferred to the temporary storage unit 4 (the given conditions are discussed later in detail). The other bills including those of unknown denominations or those with abnormal dimensions are transferred as reject bills to the reject stacker 11 of the bill deposit/withdrawal section 1 so that the reject bills are returned to the user.

When the user confirms the deposit by input operation, those bills stored temporarily in the temporary storage unit 4 are transferred again to the transfer path 2. While transferred along the transfer path 2, the bills are monitored by the sensors 6 and subjected again to judgment operation by the judgment unit 3. According to the result of denomination judgment by the judgment unit 3, each of the bills is stored in the bill cartridge 8 or 9 by the operation of the gates 7. When the judgment unit 3 detects reject bills such as folded, stained, damaged or other non-reusable bills during the judgment operation, those are transferred to the reject bill cartridge 5.

Figure 2:
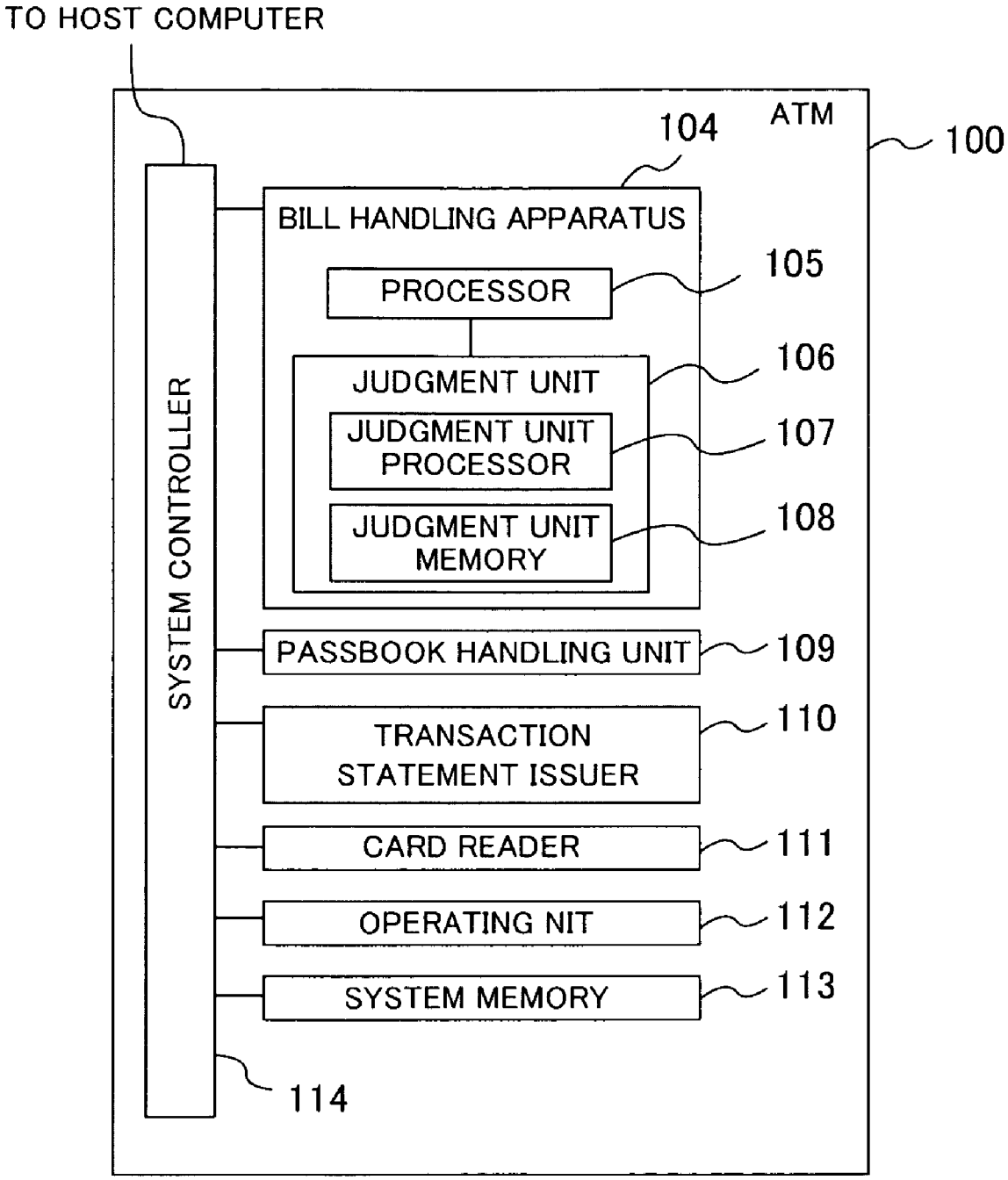
FIG. 2 illustrates the functional blocks of an ATM.

FIG. 2 illustrates the functional blocks of the ATM.

The ATM, designated 100, includes the following units: a bill handling apparatus 104 that handles bills; a passbook handling unit 109 that handles passbooks; transaction statement issuer 110 that issues transaction statements; a card reader 111 that accesses the data on cash cards; an operating unit 112 that has a guide screen to display operational guides and transaction information to users and bank clerks and an operating panel; a system memory 113 that stores programs and transaction data; and a system controller 114 that controls each of the above units. The ATM 100 is connected via a network to a host computer (not illustrated) that manages user transaction information. The system controller 114 includes a processor (not illustrated) that executes programs for the control of the above units and for the control of data transmission to/from the host computer.

The bill handling apparatus 104 includes a processor 105 that controls the handling of bills in general including bill transfer according to a given program and also includes the judgment unit 106. The processor 105 functions as a control unit for the handling of bills.

The judgment unit 106 includes its own processor 107 and memory 108. The judgment unit processor 107 examines the denominations, authenticity, and status of bills according to a given program to judge the positions and directions of folds (which corner of a bill is folded in which direction, forward or backward) and the height of the bills (the "height" of a bill is defined herein as the distance between the two long sides of the bill). The judgment unit memory 108 stores image information on bills acquired with optical sensors 405 and 406 (shown in FIG. 4A) and also stores the positions and directions of bill folds and the height and transfer destinations of the bills. How to store judgment results of bills will be later described with reference to FIG. 11. Also, the handling of deposited bills and folded bills will be later described with reference to FIGS. 12 to 14.

Figure 3A:
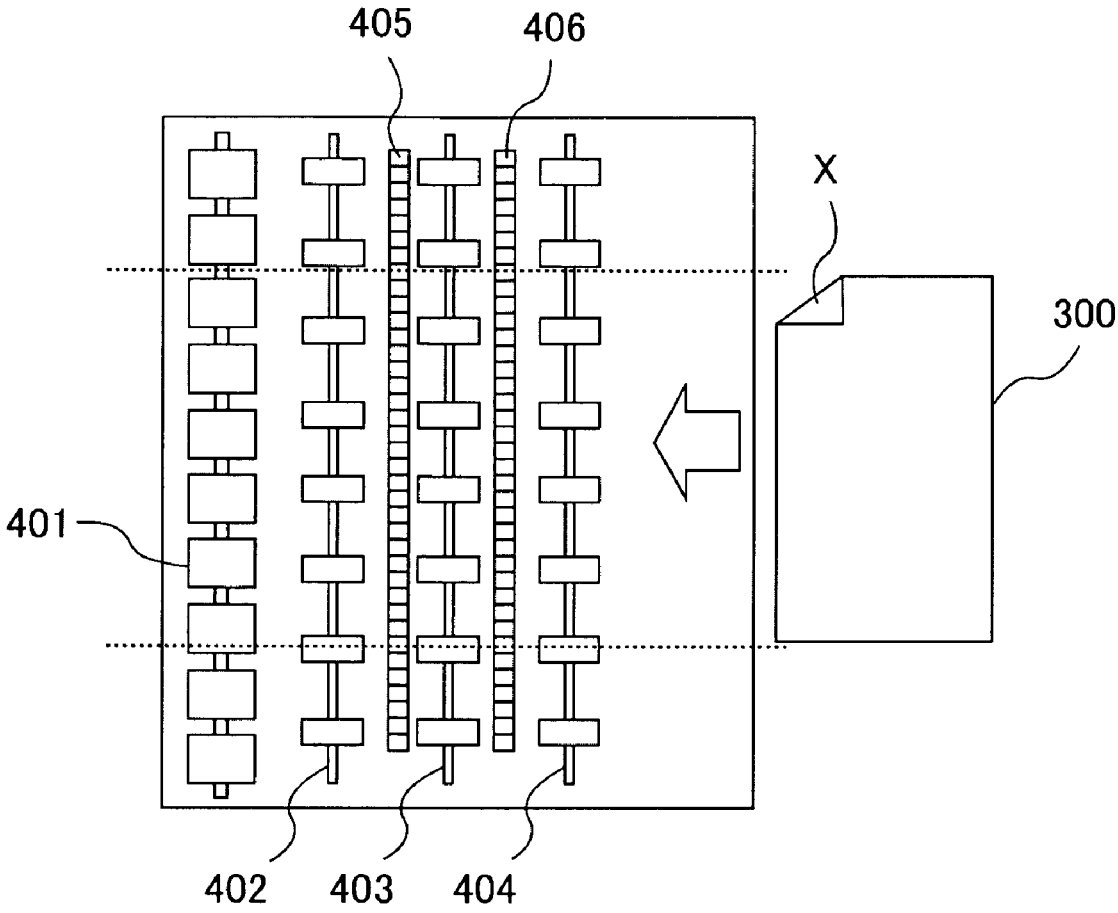
FIGS. 3A and 3B illustrate the configuration of a judgment unit 3.
Figure 3B:
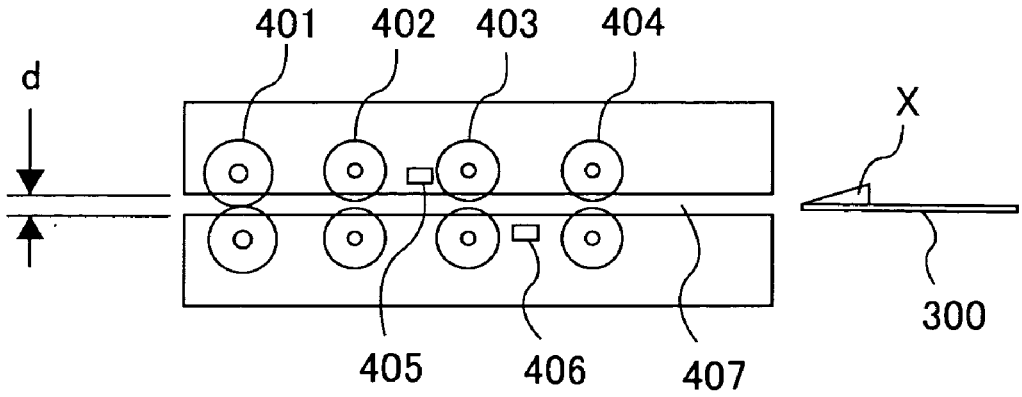

FIGS. 3A and 3B illustrate the configuration of the judgment unit 106, with FIG. 3A being a plan view and FIG. 3B a side view.

A bill 300 is transferred to the judgment unit 106 in the direction of the arrow of FIG. 3A (height direction of the bill). As shown in FIG. 3A, multiple rows of rollers 401, 402, 403, and 404 are arranged across the transfer path 2 to guide the bill 300 along the transfer path 2. At least one of the rows of rollers 402, 403, and 404 imparts transfer force to the bill 300. The rollers 401 are thickness detection rollers that have the sensor function to detect the thickness of the bill 300. The thickness detection rollers 401 are constructed such that, for example, two rows of multiple rollers each with a built-in coil are arranged in the longitudinal direction of the bill 300 to be transferred, with one of the two rows of rollers arranged above the transfer path 2 and the other below the transfer path 2 and such that a space of 100 μm or thereabout is provided between the two. The thickness detection rollers 401 measure the thickness of the bill 300 by detecting the electromotive force that results from the passage of the bill 300. Because a fold at a corner of the bill 300 results in a change in the electromotive force at rollers on which the fold passes, the thickness detection rollers 401 can also detect the fold by detecting a change in the thickness of the bill 300.

As shown in FIG. 3A, when the bill 300 with a fold X is transferred along the transfer path 2, some rollers of the thickness detection rollers 401 on which the fold X passes detect the thickness equivalent to that of two bills, and the rest of the rollers of the thickness detection rollers 401 detect the thickness of one bill. The thickness detection rollers 401 do not detect any thickness for the portions of the bill 301 that do not come into contact with the rollers 401.

The reflective optical sensors 405 and 406 are provided above and below the transfer path 2, respectively, to acquire images of the bill 300. The optical sensors 405 and 406 are image sensors that have a number of sensor elements and capture images of the bill 300 in its longitudinal direction. The optical sensor 405 captures images of the upper face of the bill 300 whereas the optical sensor 406 captures images of the lower face of the bill 300.

As shown in FIG. 3B, there are clearances 407 along the transfer path 2 between the rollers 401 and 402, 402 and 403, and 403 and 404 that all have a distance d. When the bill 300 is transferred along the transfer path 2 through the judgment unit 106, the rollers 402, 403, and 404 press the fold X against the upper face of the bill 300, but the pressed fold X separates itself from the upper face of the bill 300 at the clearances 407 (at the positions of the optical sensors 405 and 406). Thus, the optical sensors 405 and 406 also capture images of the fold X separated from the upper face of the bill 300.

Figure 4:
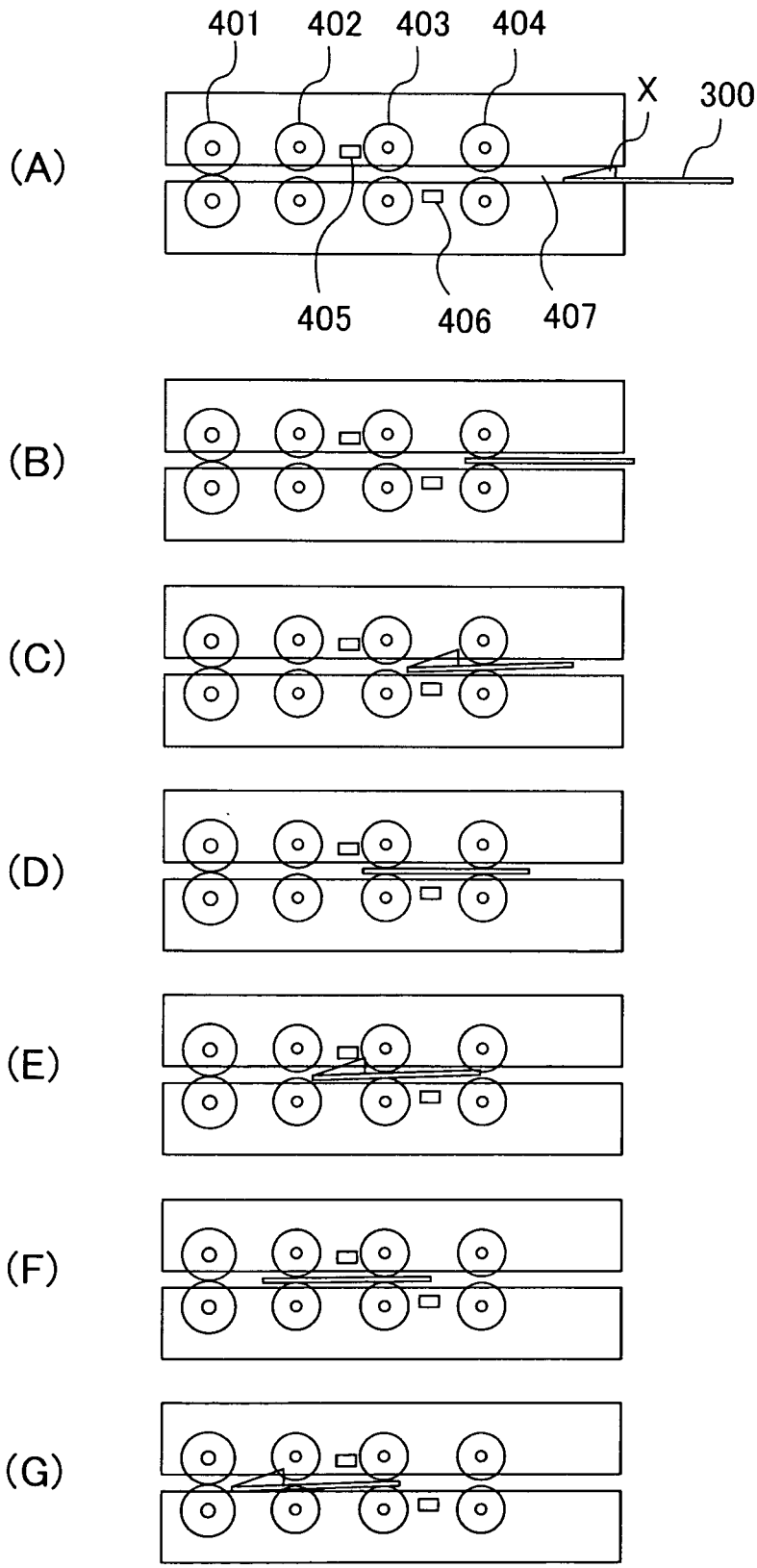
FIG. 4 illustrates the states of a folded bill when the folded bill passes through the judgment unit 3.

FIG. 4 illustrates the states of the bill 300 with the fold X when the bill 300 is transferred through the judgment unit 106.

First, the bill 300 is inserted into the clearance 407 of the transfer path 2 (FIG. 4(A)). After reaching the rollers 404, the fold X of the bill 300 is pressed against the upper face of the bill 300 by the rollers 404 (FIG. 4(B)). After passing the rollers 404, the fold X separates itself from the upper face of the bill 300 and presses the upper surface of the transfer path 2, which brings the lower face of the bill 300 closer to the optical sensor 406 (FIG. 4(C)). After reaching the rollers 403, the fold X is pressed again against the upper face of the bill 300 by the rollers 403, and the bill 300 is moved away from the optical sensor 406 (FIG. 4(D)).

After passing the rollers 403, the fold X separates itself from the upper face of the bill 300 and presses the upper surface of the transfer path 2, which means the fold X is positioned closer to the optical sensor 405. At the same time, the rest of the bill 300, or the fold-less portion of the bill 300, is moved away from the optical sensor 405 (FIG. 4(E)). After reaching the rollers 402, the fold X is pressed again against the upper face of the bill 300 by the rollers 402 (FIG. 4(F)). After the fold X passes the rollers 402, the fold-less portion of the bill 300 is moved closer to the optical sensor 405 (FIG. 4(G)).

Figure 5A:
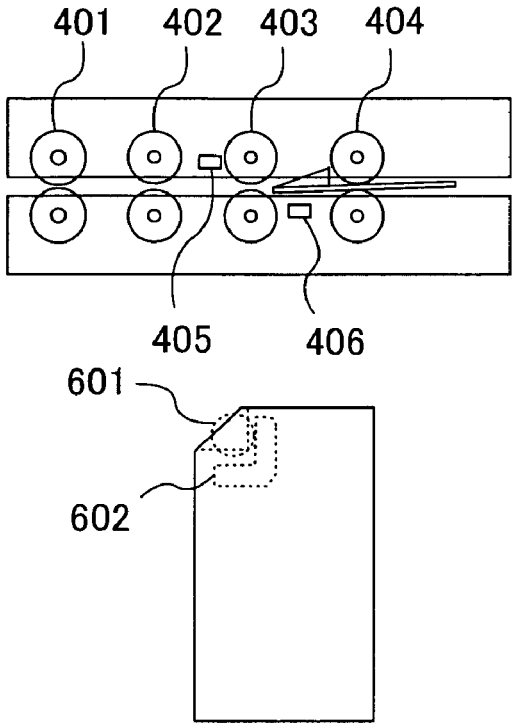
FIGS. 5A and 5B illustrate image data of a bill acquired with optical sensors.
Figure 5B:
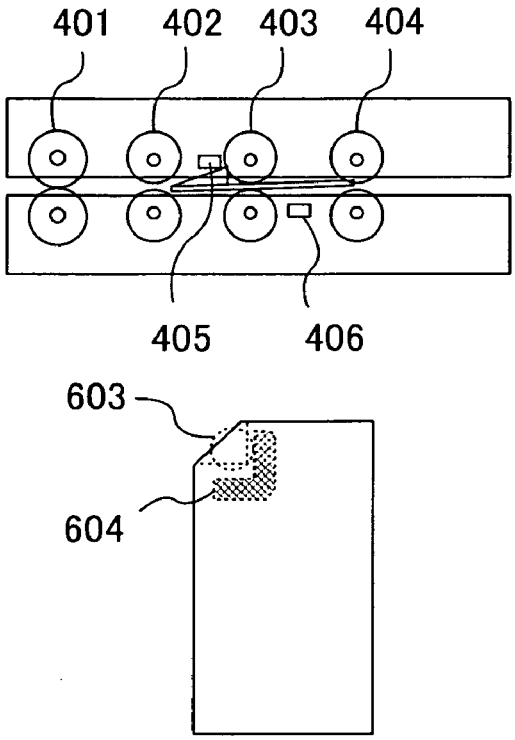

FIGS. 5A and 5B illustrate image data of the bill 300 acquired with the optical sensors 406 and 405, respectively.

As shown in FIG. 5A, the lower face of the bill 300 is moved closer to the optical sensor 406 while passing over the optical sensor 406. Thus, the optical sensor 406 receives reflected light more intensely from portions 601 and 602 of the bill 300, resulting in high sensor output at the portions 601 and 602.

As shown in FIG. 5B, while the fold X of the bill 300 passes below the optical sensor 405, the fold X is pressed against the upper surface of the transfer path 2, which means the fold X is positioned closer to the optical sensor 405. Thus, the optical sensor 405 receives reflected light more intensely from a portion 603 of the bill 300, resulting in high sensor output at the portion 603. In contrast, since a portion 604 of the bill 300, or a portion around the fold X, is positioned away from the optical sensor 405 during that time, the output of the sensor 405 is lower at the portion 604 than at the portion 603. The use of the optical sensor output at those portions 601 to 604 as well as the sensor output of the thickness detection rollers 401 enables judgment as to which direction a bill is folded in, forward or backward, which corner of the bill is folded (the positions of folds), and which direction a fold of the bill is facing in relation to a transfer direction of the bill (the directions of folds) based on the bill transfer direction and the fold position.

Figure 6A:
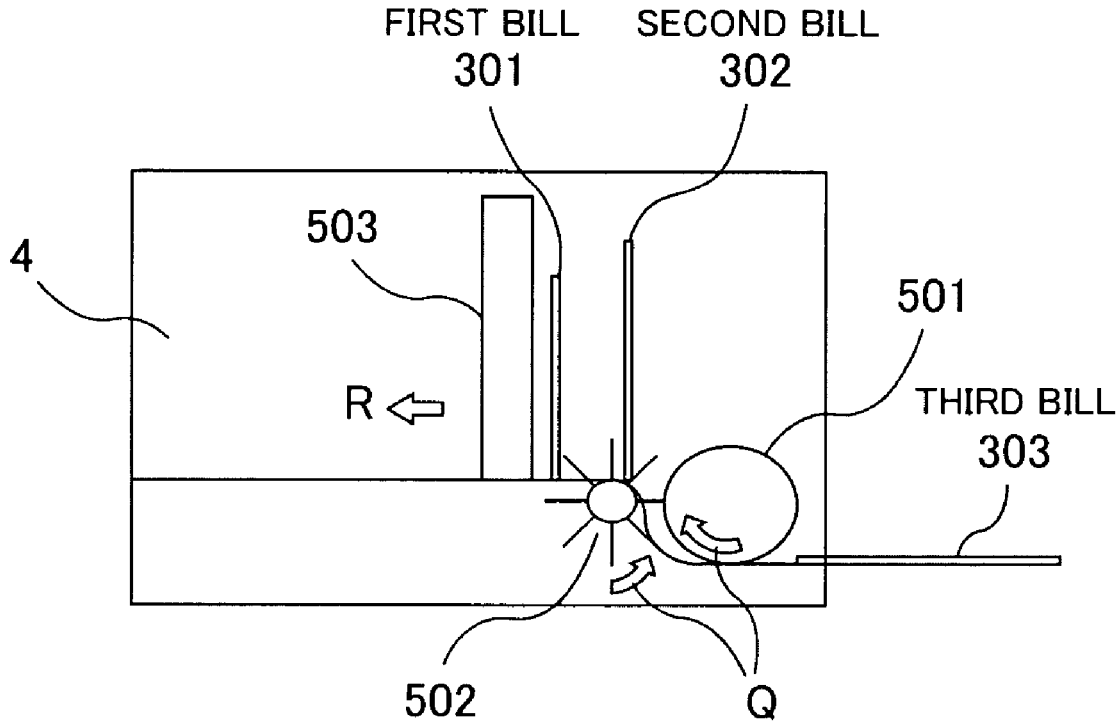
FIGS. 6A and 6B illustrate the handling of bills inside a temporary storage unit 4.
Figure 6B:
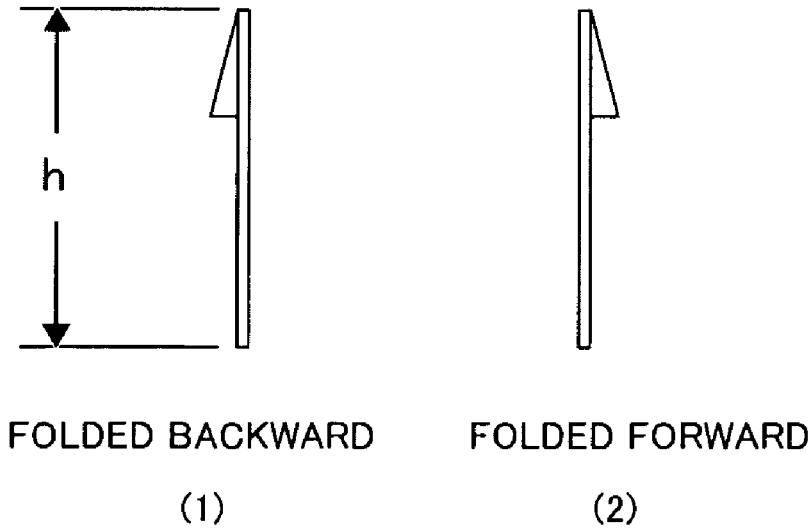

FIGS. 6A and 6B illustrate the states of bills when stored in the temporary storage unit 4.

As shown in FIG. 6A, upon bill deposit operation, a transfer roller 501 of the temporary storage unit 4 rotates in the direction of the arrow Q to introduce bills into the temporary storage unit 4. A blade roller 502 located at the entrance of the temporary storage unit 4 has soft, sheet-like blades arranged around its rotary shaft. Every time a bill is introduced into the temporary storage unit 4, the blade roller 502 rotates for the blades to press the bill against a plate 503. As multiple bills 301 to 303 are pressed sequentially against the plate 503, the plate 503 inches backward (in the direction of the arrow R) so that a number of bills can be stored in the temporary storage unit 4.

Upon bill transfer out of the temporary storage unit 4, the roller 501 and the blade roller 502 rotate in reverse, moving the plate 503 forward (in the opposite direction of the arrow R). As illustrated, the bills are transferred into the temporary storage unit 4 in numerical order, that is, from the first bill 301, the second bill 302, to the third bill 303 and transferred out of the temporary storage unit 4 in reverse order.

Here, as illustrated in FIG. 6B, reference alphabet h denotes the height of a bill (the distance between the two long sides of the bill), and the directions of the folds of FIG. 6B(1) and FIG. 6B(2) are defined as "backward" and "forward," respectively. Also, in FIG. 6B(1) and FIG. 6B(2), upper corners of the bills are folded. Note that the height h does not vary among Japanese bills regardless of their denominations; however, it does vary among euro bills of different denominations.

FIGS. 7A to 7D illustrate the states of bills each with an upper corner fold when stored in the temporary storage unit 4. In each of FIGS. 7A to 7D, the second bill 302 has an upper corner fold. The highest bill is 500 euro bill, and the lowest bill is a 50 euro bill, for example.

Figure 7A:
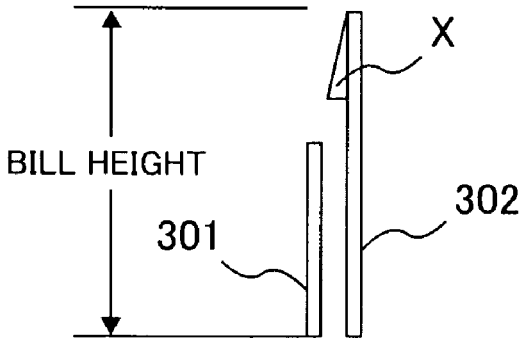
FIGS. 7A to 7D illustrate the states of bills stored in the temporary storage unit 4 (Example 1).

In FIG. 7A, the height h of the first bill 301 is smaller than the position of the fold X of the second bill 302, and the fold X faces the rear side of the temporary storage unit 4 (the backward direction). In this case, upon bill transfer out of the temporary storage unit 4, the second bill 302 is transferred out first. That means the fold X of the second bill 302 may hook the first bill 301, resulting in a double bill transfer. Therefore, the second bill 302 should not be stored in the temporary storage unit 4 and is returned to the user.

Figure 7B:
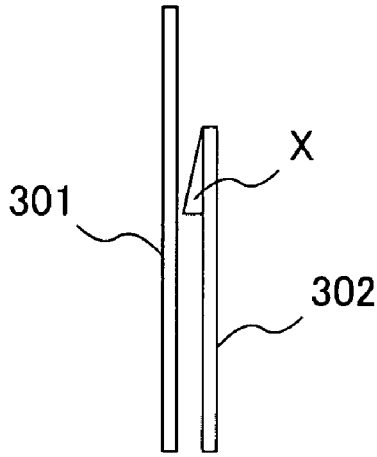

In FIG. 7B, the fold X of the second bill 302 also faces the rear side of the temporary storage unit 4 as in FIG. 7A; however, the first bill 301 is higher than the position of the fold X of the second bill 302. In this case, upon transfer of the second bill 302 out of the temporary storage unit 4, the fold X of the second bill 302 does not hook the first bill 301, resulting in no double bill transfer. Therefore, in the case of FIG. 7B, the second bill 302 is not returned to the user and stored in the temporary storage unit 4.

Figure 7C:
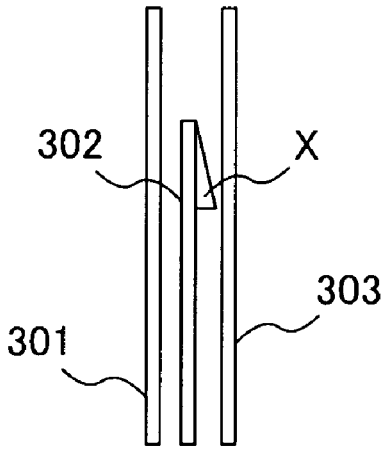

In FIG. 7C, the fold X of the second bill 302 faces the front side of the temporary storage unit 4 (the forward direction). In this case, because the third bill 303 is transferred out of the temporary storage unit 4 before the second bill 302, there is no chance of the fold X of the second bill 302 hooking any bill. Also in this case, the second bill 302 is stored in the temporary storage unit 4.

Figure 7D:
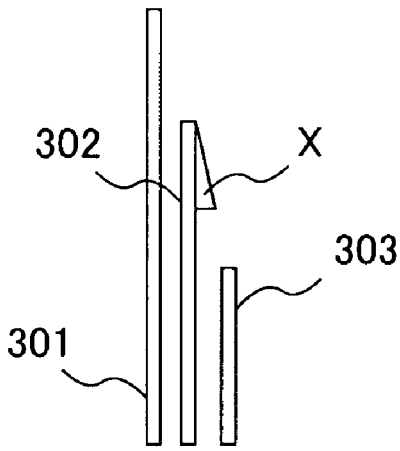

In FIG. 7D, the third bill 303 is lower than the position of the fold X of the second bill 302. Because the third bill 303 is transferred out of the temporary storage unit 4 before the second bill 302, there is no chance of the fold X of the second bill 302 hooking any bill. Also in this case, the second bill 302 is stored in the temporary storage unit 4.

Therefore, it follows that any bill with an upper corner fold can be stored in the temporary storage unit 4 unless it is in the state of FIG. 7A when inside the temporary storage unit 4. The above cases can be summarized in the form of a table as in FIG. 8. As shown in FIG. 8, in the event that a bill to be stored next is higher than the bill stored last and that the bill to be stored next is folded backward (the state of FIG. 7A), that folded bill to be stored next is transferred to the reject stacker 11 to be returned to the user. Otherwise, folded bills with upper corner folds are preferably stored in the temporary storage unit 4.

As above, transfer of a folded bill can be controlled by examining the relationship of the height and fold direction of the folded bill to those of the two bills handled before and after the folded bill so that bills of the state of FIG. 7A are returned to the user and bills of the other states are stored in the temporary storage unit 4. This enables prevention of double bill transfer due to folded bills, and folded bills stored in the temporary storage unit 4 can be reused for bill withdrawal.

With reference now to FIGS. 9A to 9D, the states of bills each with a lower corner fold are discussed when the bills are stored in the temporary storage unit 4. In each of FIGS. 9A to 9D, the second bill 302 has a lower corner fold.

Figure 9A:
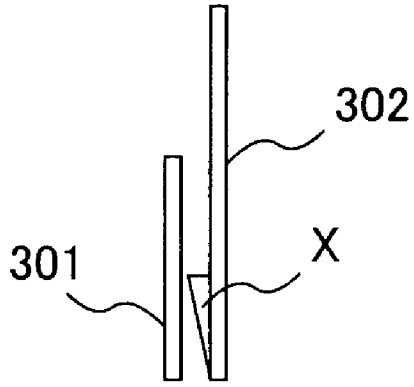
FIGS. 9A to 9D illustrate the states of bills stored in the temporary storage unit 4 (Example 2).
Figure 9B:
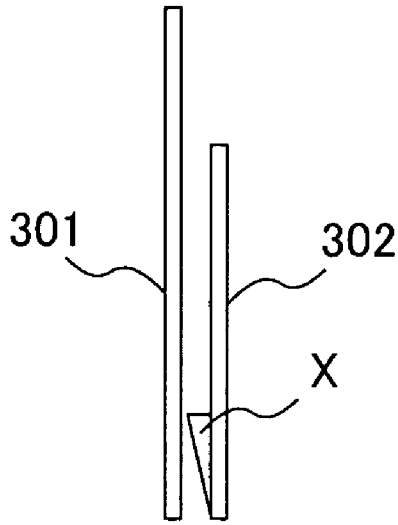

In FIGS. 9A and 9B, when the second bill 302 is transferred out of the temporary storage unit 4 before the first bill 301, there is no chance of the fold X of the second bill 302 hooking the first bill 301.

Figure 9C:
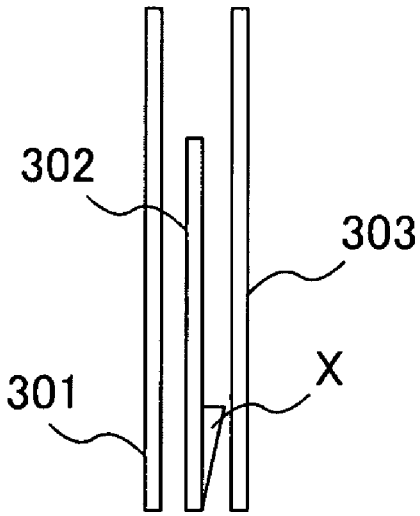
Figure 9D:
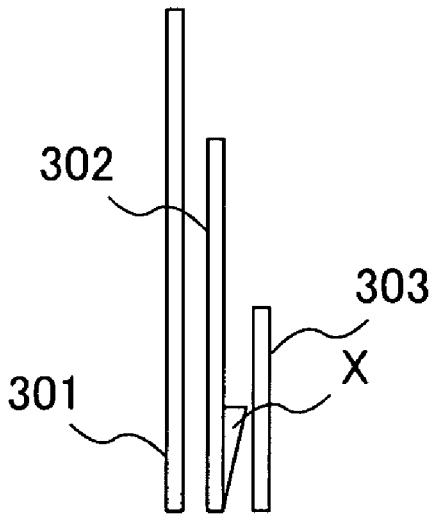

In FIGS. 9C and 9D, when the third bill 303 is transferred out of the temporary storage unit 4, there is less chance of the fold X of the second bill 302 hooking the third bill 303.

Therefore, it follows that any bill with a lower corner fold can be stored in the temporary storage unit 4. The above cases can be summarized in the form of a table as in FIG. 10.

However, when the height of the third bill 303 is extremely small as in FIG. 9D, the behavior of the third bill 303 inside the temporary storage unit 4 may be unstable, which may result in the third bill 303 rising up onto the fold X of the second bill 302. Therefore, when bills have lower corner folds and the folds face the front side of the temporary storage unit 4, such bills may be returned to the user.

Further, when the third bill 303 has an upper corner fold that faces the backward direction under the states of FIGS. 9C and 9D, the fold of the third bill 303 and the fold of the second bill 302 may hook each other upon transfer of the third bill 303 out of the temporary storage unit 4, resulting in a double bill transfer. In such cases, the third bill 303 should be returned to the user without being transferred into the temporary storage unit 4. Because the second bill 302 has no chance of hooking the first bill 301, causing no double bill transfer that involves the first bill 301, the second bill 302 is stored in the temporary storage unit 4. In the above cases, whether to store the third bill 303 in the temporary storage unit 4 is determined not based on the height of the second bill 302 and the height of the third bill 303 but based on the positions and directions of folds of the two bills 302 and 303.

FIG. 11 illustrates an exemplary storage format of the judgment unit memory 108 inside the judgment unit 106.

Every time a deposited bill passes through the judgment unit 106, information on the bill is acquired with the optical sensors 405 and 406 and the thickness detection rollers 401. With the use of the acquired information, fold positions, fold directions, and the height of the bill are examined, and the transfer destination of the bill is stored on the judgment unit memory 108. The fold positions are examined based on the information acquired with the thickness detection rollers 401 and the optical sensors 405 and 406; the fold directions and the bill height are examined based on the information acquired with the optical sensors 405 and 406.

Bills which are likely to cause double bill transfer are transferred to the reject stacker 11 to be returned to the user, and bills which are unlikely to cause double bill transfer are stored in the temporary storage unit 4.

Figure 12:
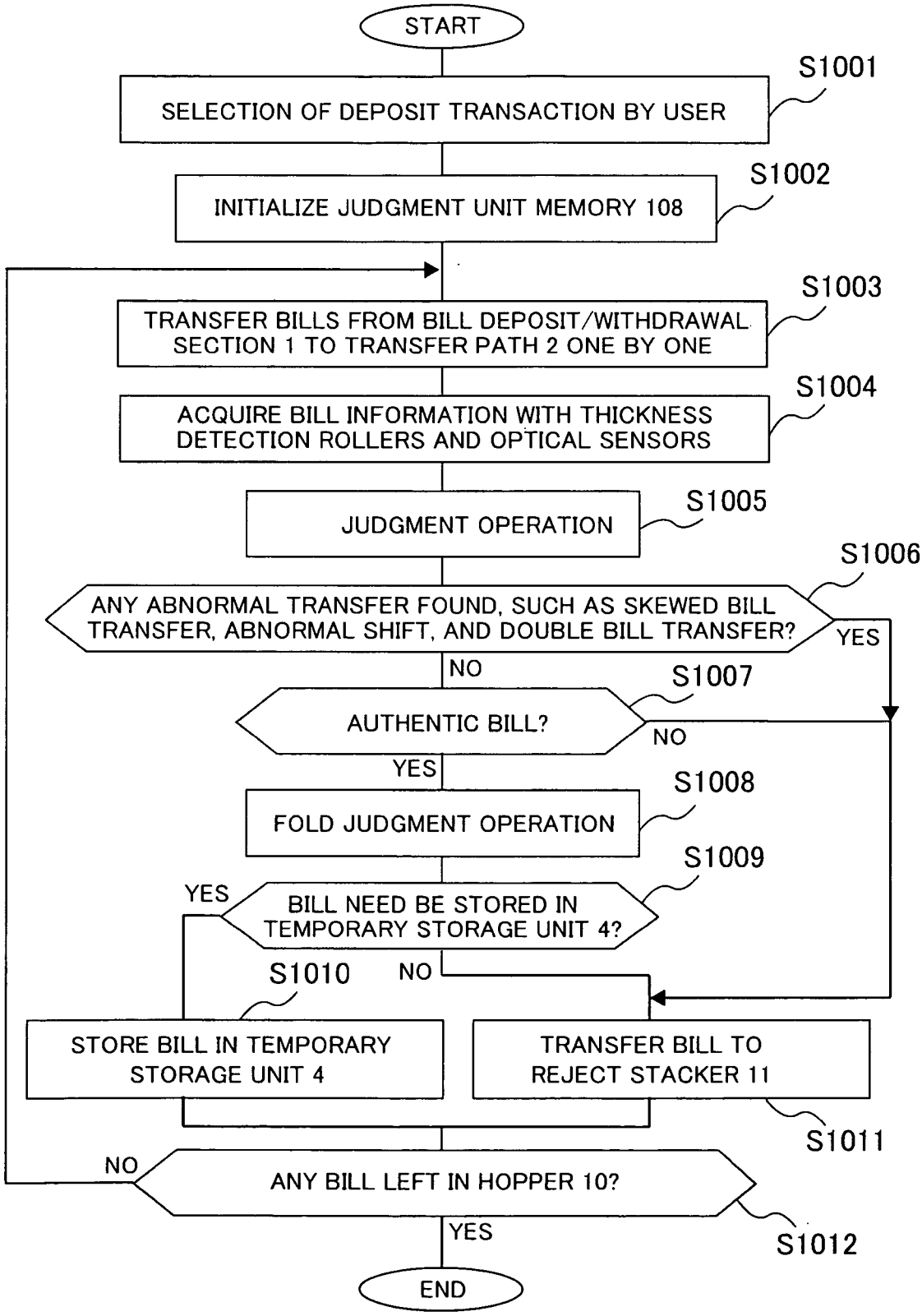
FIG. 12 is a flowchart for bill handling operation upon bill deposit transaction.
Figure 13:
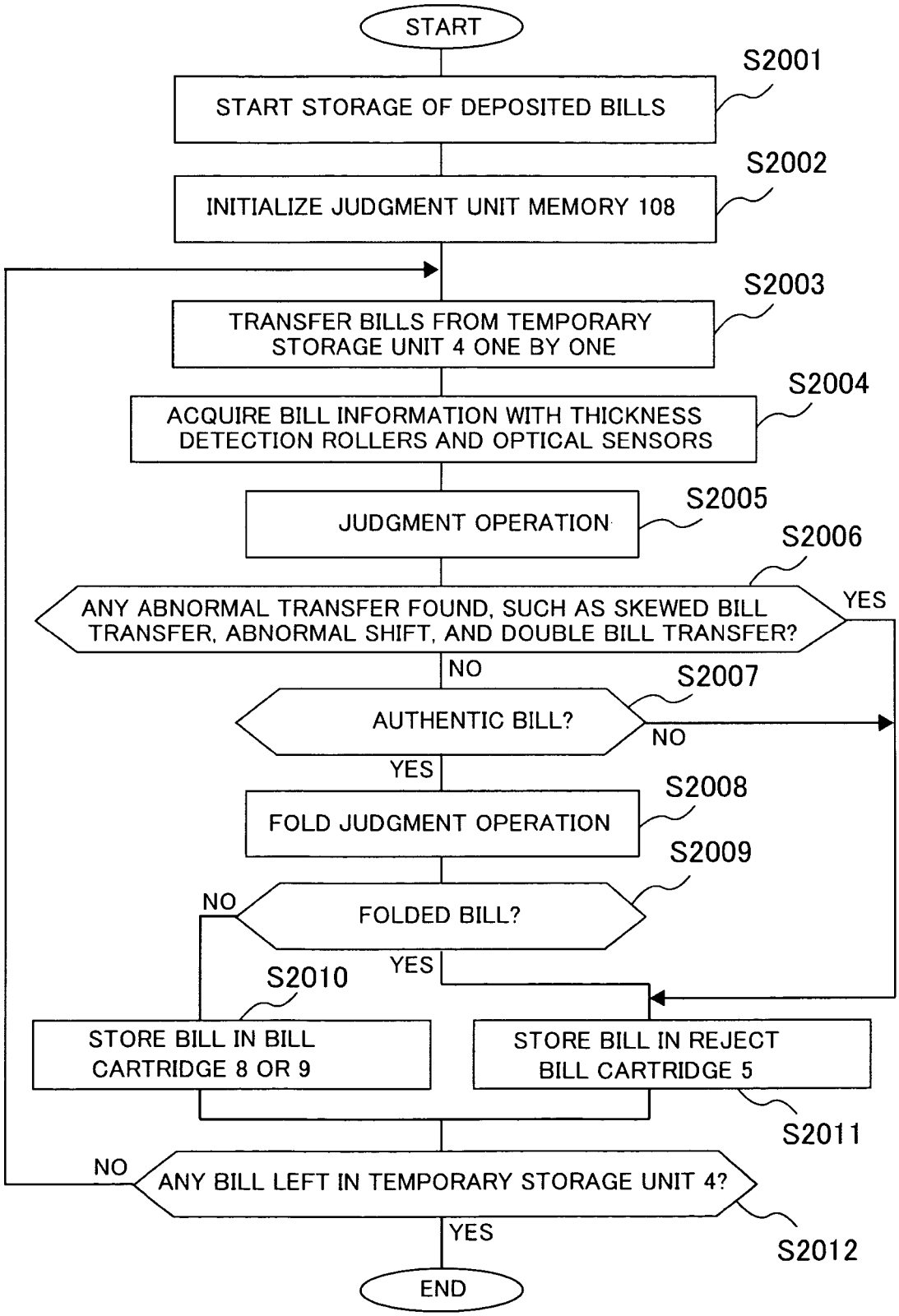
FIG. 13 is a flowchart for transferring bills from the temporary storage unit 4 to bill cartridges.
Figure 14:
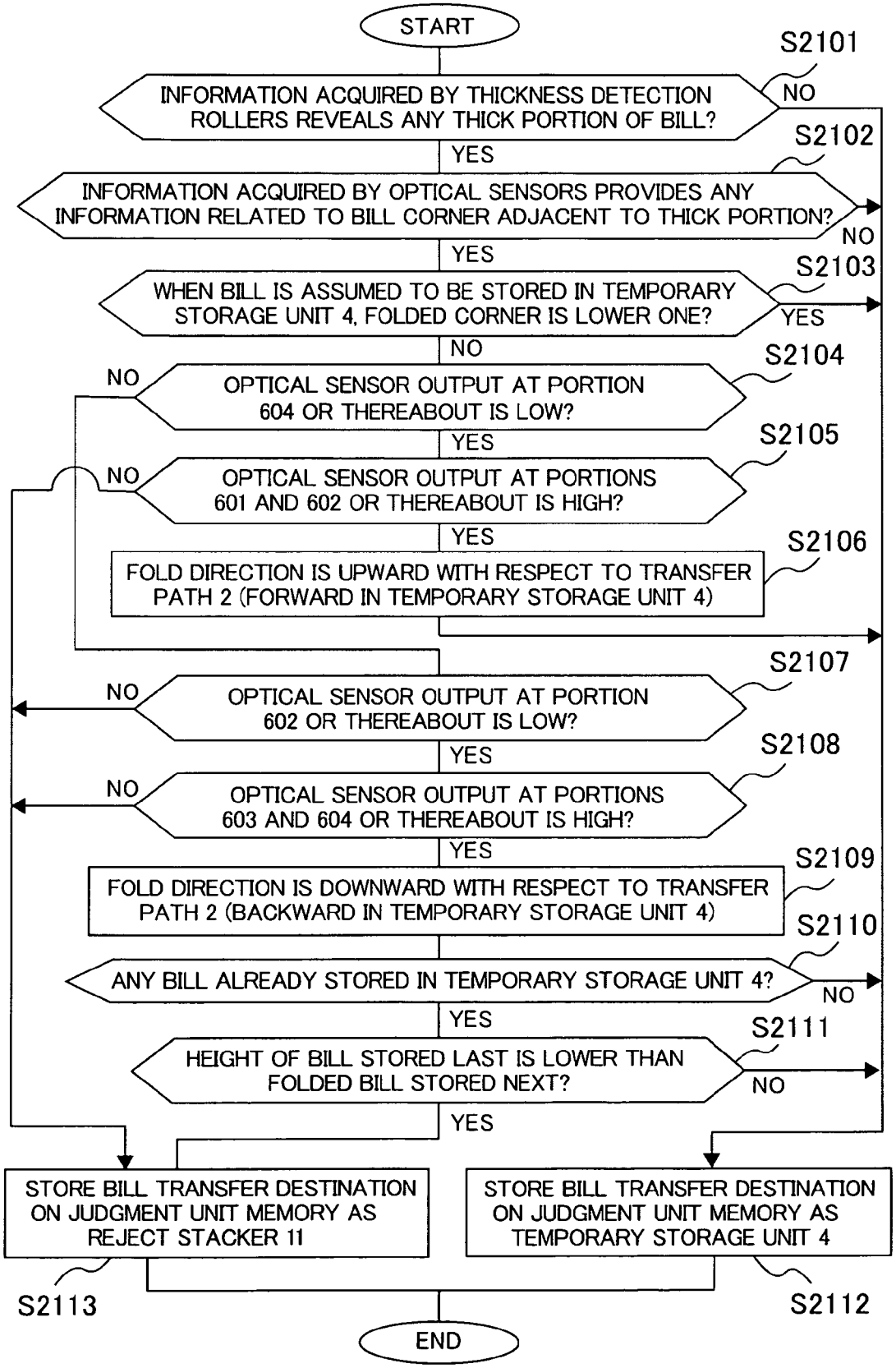
FIG. 14 is a flowchart for fold judgment operation.

With reference to FIGS. 12 to 14, the handling of bills is discussed next.

With reference first to FIG. 12, the handling of bills upon bill deposit operation is discussed.

When the user selects deposit transaction with the operating unit 112 (Step S1001), the system controller 114 instructs the processor 105 of the bill handling apparatus 104 to start deposit operation. The processor 105 in turn instructs the judgment unit processor 107 of the judgment unit 106 to initialize the judgment unit memory 108 (Step S1002). The system controller 104 then instructs the processor 105 of the bill handling apparatus 104 to transfer bills placed by the user in the hopper 10 of the bill deposit/withdrawal section 1 to the transfer path 2 (Step S1003). With this instruction of the system controller 104, the bills are transferred one by one from the bill deposit/withdrawal section 1 to the transfer path 2 under the control of the processor 105.

The bills are transferred along the transfer path 2 through the judgment unit 106. At the judgment unit 106, the thickness detection rollers 401 detect the thickness of the bills, and the optical sensors 405 and 406 capture images of the bills (Step S1004). Then, the judgment unit 106 judges the denominations, authenticity, and states of the bills one by one with the use of the information acquired with the thickness detection rollers 401 and the optical sensors 405 and 406 (Step S1005). If the judgment result reveals any abnormal bill transfer such as skewed bill transfer, abnormal shifts, or double bill transfer (yes to Step S1006), such bills are transferred to the reject stacker 11 to be returned to the user (Step S1011). If any counterfeit bills or those that cannot be judged in denomination are found (no to Step S1007), such bills are also transferred to the reject stacker 11 to be returned to the user (Step S1011).

Next, authentic bills are subjected to fold judgment operation (Step S1008). Fold positions, fold directions, bill heights are stored on the judgment unit memory 108 as the judgment result (refer to FIG. 11). If folded bills are found, their transfer destinations are determined according to the tables of FIGS. 8 and 10 and stored on the judgment unit memory 108 (Step S1009). When the transfer destination of a folded bill is to the temporary storage unit 4, that bill is transferred to the temporary storage unit 4 for storage (Step S1010). When the transfer destination of a folded bill is to the reject stacker 11, that bill is transferred to the reject stacker 11 to be returned to the user (Step S1011). This fold judgment operation is later described in detail with reference to FIG. 14.

Steps S1003 to S1011 are repeated until no bills are left in the hopper 10 (Step S1012).

With reference next to FIG. 13, a bill transfer operation is described in which bills stored in the temporary storage unit 4 are transferred to the bill cartridge 8 or 9 or the reject bill cartridge 5.

After the user confirms with the operating unit 112 the deposit the user has made, the deposit transaction is settled. This starts the operation of transferring the deposited bills stored in the temporary storage unit 4 into the bill cartridge 8 or 9, each of the cartridges storing bills of a particular denomination (Step S2001). The system controller 114 then instructs the processor 105 of the bill handling apparatus 104 to transfer the bills in the temporary storage unit 4 into the bill cartridge 8 or 9. The processor 105 in turn instructs the judgment unit processor 107 of the judgment unit 106 to initialize the judgment unit memory 108 (Step S2002). With this initialization, the data in the table of FIG. 11 is deleted, which puts the table on standby for deposit transaction by a next user.

The bills in the temporary storage unit 4 are transferred to the transfer path 2 one by one (Step S2003). The bills transferred along the transfer path 2 enter the judgment unit 106, where the thickness detection rollers 401 detect the thickness of the bills and the optical sensors 405 and 406 capture images of the bills (Step S2004). Then, the judgment unit 106 judges the denominations, authenticity, and states of the bills one by one with the use of the information acquired with the thickness detection rollers 401 and the optical sensors 405 and 406 (Step S2005). If the judgment result reveals any abnormal bill transfer such as skewed bill transfer, abnormal shifts, or double bill transfer (yes to Step S2006), such bills are transferred to the reject bill cartridge 5 for storage (Step S2011). If any counterfeit bills or those that cannot be judged in denomination are found (no to Step S2007), such bills are also transferred to the reject bill cartridge 5 for storage (Step S2011).

Next, authentic bills are subjected to fold judgment operation (Step S2008). Similar to the bill deposit operation of FIG. 12, the presence or absence of folds, fold directions, bill heights, and transfer destinations are stored on the judgment unit memory 108 as the judgment result. However, upon bill storage into the bill cartridges, the transfer destination information stored on the judgment unit memory 108 is not utilized. If folded bills are found (yes to Step S2009), they are transferred into the reject bill cartridge 5 regardless of the directions of the folds (Step S2011) so that they cannot be distributed to users in subsequent transactions. This reduces the chance of circulation of folded bills, also reducing the chance of double bill transfer in subsequent deposit transactions.

Bills judged to be authentic and without folds are stored in the bill cartridge 8 or 9 (Step S2010) so that they can be used for subsequent withdrawal transactions.

Steps S2003 to S2011 are repeated until no bills are left in the temporary storage unit 4 (Step S2012).

With reference now to FIG. 14, the fold judgment operation is described in detail.

First, the information on the thickness of the entire surface of a bill acquired with the thickness detection rollers 401 is examined for thick portions of the bill (Step S2101). When no thick portion is detected (no to Step S2101), the transfer destination of the bill is stored on the judgment unit memory 108 as the temporary storage unit 4 (Step S2112), terminating the fold judgment operation.

When any thick portion is detected from the bill thickness information acquired with the thickness detection rollers 401 (yes to Step S2101), the profile of the bill is also examined with the use of its images acquired with the optical sensors 405 and 406 for any thick portion at the bill corners (Step S2102). Even when a thick portion is found at one of the bill corners, such a thick portion may be due to a substance attached to the one of the bill corners, not due to a fold. In such cases (no to Step S2102), the transfer destination of the bill is stored on the judgment unit memory 108 as the temporary storage unit 4 (Step S2112), terminating the fold judgment operation.

When a thick portion (i.e., a fold X) which is not a result of an attached substance is found in Step S2102 (yes to Step S2102), it is then judged whether the fold X is located at one of the lower corners of the bill when the bill is inside the temporary storage unit 4 (Step S2103). If so (yes to Step S2103), the transfer destination of the bill is stored on the judgment unit memory 108 as the temporary storage unit 4 as in FIG. 10 (Step S2112), terminating the fold judgment operation. If not (no to Step S2103), it is judged whether optical sensor output obtained near the portion 604 adjacent to the fold X is lower than when the bill is without the fold X (Step S2104). When the optical sensor output is lower, the most likely reason is that the fold X pressed the upper surface of the transfer path 2, moving the portion 604 away from the optical sensor, as in FIG. 5B. In contrast, when the optical sensor output is higher, the most likely reason is that the fold X pressed the lower surface of the transfer path 2, moving the portion 604 closer to the optical sensor.

When the optical sensor output obtained near the portion 604 is lower (yes to Step S2104), it is then judged whether optical sensor output obtained near the portions 601 and 602, which correspond to the back side of the portion 604 or thereabout, is higher than when the bill is without the fold X (Step S2105). When the optical sensor output is higher (yes to Step S2105), the most likely reason is that the fold X pressed the upper surface of the transfer path 2, moving the portions 601 and 602 closer to the optical sensor, as in FIG. 5A. In contrast, when the optical sensor output is equal to or lower than when the bill is without the fold X (no to Step S2105), the direction of the fold X cannot be determined with certainty, and the transfer destination of the bill is stored on the judgment unit memory 108 as the reject stacker 11 just in case (Step S2113).

When the conditions of Steps S2104 and S2105 are both met (yes to both of Steps S2104 and S2105), the direction of the fold X can be judged to be "upward" with respect to the transfer path 2 ("forward" when the bill is inside the temporary storage unit 4) (Step S2106). In this case, the transfer destination of the bill is stored on the judgment unit memory 108 as the temporary storage unit 4 (Step S2112), terminating the fold judgment operation.

When the optical sensor output obtained near the portion 604 is not lower (no to Step S2104), it is then judged whether optical sensor output obtained near the portion 602, which corresponds to the back side of the portion 604, is lower than when the bill is without the fold X (Step S2107). When the optical sensor output obtained near the portion 602 is lower (yes to Step S2107), the most likely reason is that the fold X pressed the lower surface of the transfer path 2, moving the portion 602 away from the optical sensor. When the optical sensor output obtained near the portions 604 and 602 is not lower (no to Steps S2104 and S2107), the direction of the fold X cannot be determined with certainty, and the transfer destination of the bill is stored on the judgment unit memory 108 as the reject stacker 11 just in case (Step S2113).

When the optical sensor output obtained near the portion 602 is lower (yes to Step S2107), it is then judged whether optical sensor output obtained near the portions 603 and 604, which correspond to the back side of the portion 602 or thereabout, is higher than when the bill is without the fold X (Step S2108). If so (yes to Step S2108), the most likely reason is that the fold X pressed the lower surface of the transfer path 2, moving the portions 603 and 604 closer to the optical sensor. When the optical sensor output obtained near the portions 603 and 604 is equal to or lower than when the bill is without the fold X (no to S2108), the direction of the fold X cannot be determined with certainty, and the transfer destination of the bill is stored on the judgment unit memory 108 as the reject stacker 11 just in case (Step S2113).

When the conditions of Steps S2107 and S2108 are both met (yes to both of Steps S2107 and S2108), the direction of the fold X can be judged to be "downward" with respect to the transfer path 2 (Step S2109). In this case, the direction of the fold X is "backward" when the bill is inside the temporary storage unit 4, which mean that the bill cannot be transferred into the temporary storage unit 4 depending on the height of the bill stored last in the temporary storage unit 4. If no bills are stored in the temporary storage unit 4 before the bill in question (no to Step S2110), however, there is no chance of double bill transfer. In that case, the transfer destination of the bill is stored on the judgment unit memory 108 as the temporary storage unit 4 (Step S2112), terminating the fold judgment operation.

If any bill is stored in the temporary storage unit 4 before the bill in question (yes to Step S2110), the bill stored last is compared with the bill in question in terms of height with the use of the height information stored on the judgment unit memory 108 (Step S2111). When the height of the bill stored last is smaller than that of the bill in question (yes to Step S2111), there is a good chance of double bill transfer. Thus, the transfer destination of the bill in question is stored on the judgment unit memory 108 as the reject stacker 11 (Step S2113). When, in contrast, the height of the bill stored last is higher than that of the bill in question (no to Step S2111), there is no chance of double bill transfer. In this case, the transfer destination of the bill in question is stored on the judgment unit memory 108 as the temporary storage unit 4 (Step S2112).

As above, the bill handling apparatus (ATM) according to the invention stores even such folded bills as would commonly be returned to the user without returning them to the user if the apparatus judges the probability of double bill transfer to be low by considering fold positions and fold directions of a folded bill in relation to the height of a bill transferred immediately before the folded bill. This leads to improvement in the operating rate of the ATM. Because such folded bills are not returned to the user, this can save the time for the user to unfold and straighten folded bills and deposit them again.

A paper handling apparatus according to the invention can be embodied in other various forms without being limited to the foregoing embodiment.

The foregoing embodiment is an exemplary embodiment in which the invention is applied to an ATM having bill deposit/withdrawal functions. The invention is not limited thereto but can be applied, for example, to the handling of valuable papers such as checks and lottery tickets.

Further, in the foregoing embodiment, data in the table of FIG. 11 stored on the judgment unit memory 108 is to be deleted when a bill is transferred from the temporary storage unit 4 to the bill cartridge 8 or 9. However, the data in the table may not be deleted at that time but may be kept for a particular amount of time thereafter.

Furthermore, the table format of FIG. 11 is only meant to be an example and can be modified as desired.

What is claimed is:

1. A paper handling apparatus for handling a plurality of pieces of paper being transferred on a transfer path, the apparatus being utilized by a user and comprising:

a first sensor located along the transfer path for detecting a thickness of the plurality of pieces of paper;

a second sensor located along the transfer path for acquiring images of the plurality of pieces of paper, the images showing profiles and surfaces of the plurality of pieces of paper;

a judgment unit for judging positions and directions of folds of the plurality of pieces of paper with respect to the transfer path using the thickness information acquired with the first sensor and the images acquired with the second sensor, the judgment unit judging each direction of the folds of the plurality of pieces of paper to be upward or downward with respect to the transfer path; and a control unit for controlling the apparatus such that when a judgment result of the judgment unit shows that the position and direction of a fold of a first piece of paper are in a state of a chance of double bill transfer in relation to a second piece of paper located immediately before or after the first piece of paper in the plurality of pieces of paper, the first piece of paper is kept in the apparatus without being returned to the user.

2. The paper handling apparatus of claim 1, further comprising:

a temporary storage unit for temporarily storing bills deposited by the user; and a plurality of cartridges for storing bills usable for withdrawal, each of the plurality of cartridges storing bills of a particular denomination, the plurality of cartridges being connected via a transfer path to the temporary storage unit, wherein if the judgment unit judges, upon transfer of the bills deposited by the user to the temporary storage unit, that there is a good chance of double bill transfer during bill transfer from the temporary storage unit to the plurality of the cartridges by considering the position and direction of a fold of a folded bill among the bills deposited by the user in relation to another bill located immediately before or after the folded bill, the control unit transfers the folded bill so as to return the folded bill to the user, and if the judgment unit judges there is no chance of double bill transfer, the control unit transfers the folded bill to the temporary storage unit.

3. The paper handling apparatus of claim 1, wherein the paper handling apparatus handles bills of various heights and of various denominations, and wherein even when the judgment unit detects, with the use of the thickness information acquired with the first sensor, a folded bill among deposited bills by the user upon-transfer of the bills deposited by the user to the temporary storage unit, the control unit transfers the folded bill so as to return the folded bill to the user if the judgment unit judges there is a good chance of double bill transfer by considering the position and direction of a fold of the folded bill and the relationship between the height of the folded bill and the height of another bill transferred immediately before or after the folded bill, and the control unit transfers the folded bill to the temporary storage unit if the judgment unit judges there is no chance of double bill transfer.

4. The paper handling apparatus of claim 1, further comprising a memory unit for sequentially storing information on the positions and directions of folds of bills and the height of the bills on a bill-by-bill basis, the information being obtained by the judgment unit.

5. The paper handling apparatus of claim 2, further comprising a reject bill cartridge for storing bills that cannot be used for withdrawal, wherein when the judgment unit detects, upon transfer of bills stored in the temporary storage unit to the plurality of bill cartridges for storage, a folded bill among the bills transferred out of the temporary storage unit, the control unit exercises control so as to transfer the folded bill to the reject bill cartridge and to transfer the rest of the bills that are not judged to be folded by the judgment unit to the plurality of bill cartridges.

6. The paper handling apparatus of claim 4, wherein the judgment unit examines all of bills deposited by the user to search for any thick portion at the corners of the bills with the use of the thickness information acquired with the first sensor and judges the positions and directions of folds of the bills and the height of the bills with the use of the image information acquired with the second sensor, and wherein the memory unit stores information on the judged positions and directions of folds of the bills and the judged height of the bills on a bill-by-bill basis in the form of a table.

7. The paper handling apparatus of claim 4, wherein if the judgment unit judges there is a good chance of double bill transfer during bill transfer by considering the relationship of a folded bill and another bill located immediately before or after the folded bill with reference to the information on the positions and directions of folds of bills and the height of the bills that is stored on the memory unit, the control unit transfers the folded bill so as to return the folded bill to the user, and if the judgment unit judges there is no chance of double bill transfer, the control unit keeps the folded bill in the apparatus.

8. A paper handling method for use in a paper handling apparatus that handles a plurality of pieces of paper being transferred on a transfer path and is utilized by a user, the method comprising:

detecting a thickness of the plurality of pieces of paper using a first sensor located along the transfer path along which the plurality of pieces of paper are transferred;

acquiring images of the plurality of pieces of paper using a second sensor located along the transfer path, the images showing profiles and surfaces of the plurality of pieces of paper;

judging positions and directions of folds of the plurality of pieces of paper with respect to the transfer path using information acquired with the first and second sensors such that each direction of the folds of the plurality of pieces of paper is judged to be upward or downward with respect to the transfer path; and controlling the apparatus such that when a judgment result of the judgment step shows that the position and direction of a fold of a first piece of paper are in a state of a chance of double bill transfer in relation to a second piece of paper located immediately before or after the first piece of paper in the plurality of pieces of paper, the first piece of paper is kept in the apparatus without being returned to the user.

9. The paper handling method of claim 8, further comprising the step of sequentially storing information on the positions and directions of folds of bills and the height of the bills on a memory unit on a bill-by-bill basis, the information being obtained by the judgment step, wherein if there is judged to be a good chance of double bill transfer during bill transfer by considering the relationship of a folded bill to another bill located immediately before or after the folded bill with reference to the information on the positions and directions of folds of the bills and the height of the bills that is stored on the memory unit, the folded bill is transferred so as to be returned to the user with the use of a control unit that controls transfer of the bills, and if there is judged to be no chance of double bill transfer, the folded bill is transferred so as to be stored in the apparatus with the use of the control unit.

* * * * *